US011342708B2

(12) United States Patent
Menez et al.

(10) Patent No.: US 11,342,708 B2
(45) Date of Patent: May 24, 2022

(54) SET OF CONNECTORS HAVING A LOCKING DEVICE

(71) Applicant: APTIV TECHNOLOGIES LIMITED, St. Michael (BB)

(72) Inventors: Frédéric Menez, Hermeray (FR); Prasanna Ramakrishnan, Chennai Tamilnadu (IN); Sureshkumar Nandakumar, Thiruvottiyur Chennai (IN); Santhanakumar Pitchamani, Chennai (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/911,958

(22) Filed: Jun. 25, 2020

(65) Prior Publication Data

US 2020/0412052 A1 Dec. 31, 2020

(30) Foreign Application Priority Data

Jun. 28, 2019 (FR) ..... 1907214

(51) Int. Cl.
*H01R 13/62* (2006.01)
*H01R 13/627* (2006.01)
(Continued)

(52) U.S. Cl.
CPC ..... *H01R 13/6272* (2013.01); *H01R 13/639* (2013.01); *H01R 13/642* (2013.01)

(58) Field of Classification Search
CPC . H01R 13/6272; H01R 13/639; H01R 13/642
(Continued)

(56) References Cited

U.S. PATENT DOCUMENTS 6,435,895 B1 * 8/2002 Fink ..... H01R 13/6272 439/352
6,568,954 B2 * 5/2003 Endo ..... H01R 13/641 439/352
(Continued)

FOREIGN PATENT DOCUMENTS

EP 1 928 061 A2 6/2008
EP 1 928 061 A3 6/2008
(Continued)

OTHER PUBLICATIONS

Chinese Office Action for Chinese Application No. 202010596832 dated Jul. 30, 2021.
(Continued)

*Primary Examiner* — Alexander Gilman
(74) *Attorney, Agent, or Firm* — Carlson, Gaskey & Olds, P.C.

(57) ABSTRACT

A set of electrical connectors includes a connector and a mating connector. The connector comprises a locking device mounted on a housing so as to slide in a locking direction between a pre-locking position and a locking position. The connector also has a latch. The latch is provided with a locking surface for locking the connector to the mating connector. The latch extends between a junction that joins it to the body of the housing and at least the locking surface in a direction opposite to the locking direction.

12 Claims, 11 Drawing Sheets

(51) Int. Cl.
*H01R 13/639* (2006.01)
*H01R 13/642* (2006.01)

(58) Field of Classification Search
USPC ..... 439/352
See application file for complete search history.

(56) References Cited

U.S. PATENT DOCUMENTS 6,824,417 B1 * 11/2004 Nimura ..... H01R 13/641 439/352
7,043,834 B2 * 5/2006 Endo ..... H01R 13/641 29/842
7,559,787 B2 * 7/2009 Shigeta ..... H01R 13/6272 439/358
8,926,356 B2 * 1/2015 Kon ..... H01R 13/6272 439/352
9,054,458 B1 * 6/2015 Ng ..... H01R 13/641
9,160,095 B2 * 10/2015 Littek ..... H01R 13/422
9,350,116 B1 * 5/2016 Morello ..... H01R 13/639
9,425,534 B2 * 8/2016 Schmidt ..... H01R 13/6272
9,831,601 B2 * 11/2017 Kim ..... H01R 13/639
9,923,297 B2 * 3/2018 Sekino ..... H01R 13/502
9,979,123 B2 * 5/2018 Sekino ..... H01R 13/62
9,979,131 B2 * 5/2018 Venkatesan ..... H01R 13/639
2003/0003792 A1 * 1/2003 Endo ..... H01R 13/641 439/352
2008/0132105 A1 6/2008 Kobayashi et al.
2009/0149054 A1 * 6/2009 Zheng ..... H01R 13/641 439/357
2013/0260590 A1 * 10/2013 Hitchcock ..... H01R 13/6397 439/312
2017/0250502 A1 8/2017 Endo et al.
2018/0034206 A1 * 2/2018 Sekino ..... H01R 13/6278
2018/0034210 A1 * 2/2018 Sekino ..... H01R 13/6272

FOREIGN PATENT DOCUMENTS

EP 3 016 213 B1 10/2014
EP 3 016 213 A1 5/2016
EP 3 211 731 A1 8/2017
EP 3 252 880 A1 12/2017
WO 2014/060229 A1 4/2014
WO 2017187318 A1 11/2017

OTHER PUBLICATIONS

French Search Report for Application No. FR1907214 dated May 25, 2020.

* cited by examiner

SET OF CONNECTORS HAVING A LOCKING DEVICE

CROSS REFERENCE TO RELATED APPLICATION

This application claims priority to French Application No. FR1907214, filed on Jun. 28, 2019.

TECHNICAL FIELD

The invention relates to the field of connector technology and notably motor vehicle connector technology.

BACKGROUND

Motor vehicle electrical connectors are often fitted manually by an operator. This is also a repetitive operation for this operator. It is also possible for this manual operation of coupling two connectors to be carried out without any visual, acoustic or sensory feedback (on account of the size of the spaces in which the fitting and connection have to be carried out, the surrounding noise, the use of gloves, etc.). The connectors are thus equipped with devices for ensuring the position of the contacts (well known as "TPA", or terminal position assurance, devices) so as to ensure that the contact points are correctly positioned in order to optimize the reliability of the electrical connection. The connectors are also equipped with devices for ensuring the full coupling thereof (well known as "CPA", or connector position assurance, devices), which also make it possible to lock the connectors when they are correctly and fully coupled. This makes it possible to reinforce the mechanical strength of the connection. In this document, the "CPA" device for ensuring the position of the connectors is referred to as "locking device".

Generally, this type of locking device has to be moved, after one connector has been fully coupled to another connector or mating connector, into a locking position. In order to prevent the operator from effecting defective or incomplete coupling, it is only possible to move the locking device into its locking position if the coupling has been performed correctly. Thus, for example, a latch ensures primary locking of the coupled connector and mating connector. By contrast, this latch blocks the movement of the locking device towards its locking position if the coupling is incomplete. Notably, connectors are known that are provided with a latch having a protuberance or a tooth suitable for engaging in a respective notch or aperture provided in the housing of a mating connector in order to lock the connector and the mating connector together once they have been fully coupled. An example of a connector of this type, provided with a locking device that is movable between a pre-locking position and a locking position, is described for example in the patent documents published under the respective numbers EP3016213B1, US2018034206A1, EP3211731A1 et EP1928061A2.

An alternative to the configurations known from the prior art for the connector and its locking device is proposed.

SUMMARY

An illustrative example embodiment of a set of electrical connectors includes a connector and a mating connector. The connector and the mating connector are coupled together, when one is moved relative to the other, in a coupling direction, as far as a final coupling position. The connector comprises a housing and a locking device mounted on the housing in a sliding manner. The locking device is thus movable in a locking direction between a pre-locking position and a locking position. The housing comprises a housing body and a latch provided with a locking surface.

Moreover, the latch extends between a junction that joins it to the body of the housing and at least the locking surface in a direction opposite to the coupling direction.

The connector is provided with a latch referred to as a "rear latch", in contrast to the connector described in the patent document published under the number EP 3 016 213 B1, which is provided with a latch referred to as a "front latch". The latch of the set of connectors is a latch referred to as a "rear latch" since the locking surface is situated towards the rear of the connector, while it is articulated towards the front of the connector. A rear latch may possibly have a number of advantages, including the following: it is compatible with a more compact locking device, it can be used with or without a locking device (a connector having a front latch cannot function without a locking device), the locking device is compatible with a connector that is not sealed; specifically, most connectors that are not sealed have a rear latch and therefore do not allow the use of a locking device designed for a front latch, its orientation makes it less fragile with regard to its interaction with a mating connector (the mating connector and the free end of the latch cannot collide frontally during the coupling of the connector to the mating connector), and it is compatible with tool-free disconnection of the connector and the mating connector.

The set of connectors therefore comprises a connector having a smart locking system ("SLS").

This set of connectors optionally comprises one and/or another of the following features, each considered independently of one another, or each in combination with one or more others:

the latch is provided with a blocking surface;

the latch flexes from a blocking position to a retracted position; in the blocking position, the blocking surface cooperates with the locking device to block the movement of the locking device, towards the locking position, when the latter is in the pre-locking position; in the retracted position, the mating connector cooperates with the latch to release the locking device from the blocking surface;

the blocking surface is situated along the latch (parallel to the coupling and locking directions), on the same side as the locking surface, with respect to the junction that joins the latch to the body of the housing;

the mating connector has a skirt, inside which the latch is primarily accommodated when the connector and the mating connector are in the final coupling position;

the locking device has a locking arm that is primarily accommodated inside the skirt when the connector and the mating connector are in the final coupling position;

the latch has a protuberance, or a tooth, and the mating connector has a notch, or an aperture, into which the protuberance, or the tooth, is inserted to allow the latch to return into the blocking position, in which the protuberance, or the tooth, cooperates with the mating connector to ensure primary locking of the connector and the mating connector in the coupling position;

the locking device has a locking arm with a lug, or a finger, that cooperates with the mating connector in order to keep the locking arm flexed and allow the locking device to be moved from its pre-locking position to its locking position, this lug, or this finger, being accommodated in the notch, or the aperture, when the locking device is in the locking position;

the locking device has a support surface that cooperates with the latch in order to effect secondary locking of the connector and the mating connector in the coupling position;

the locking device has a wall, or a roof, at least partially covering a free end of the latch when the locking device is in the locking position;

the locking device has an unlocking surface that cooperates with the latch in order to release it from the mating connector when the locking device is moved from its locking position to its pre-locking position.

According to another aspect, an electrical connector may be a connector for connecting to a mating connector having a skirt in which a notch or an aperture is provided, into which a protuberance or a tooth is inserted in order to lock the connector and the mating connector together. This type of mating connector is relatively standard, but those that form the technological background are not connected to a connector comprising a locking device ("CPA") for ensuring the full coupling position of the connector relative to the mating connector.

Thus, the connector comprises a housing and a locking device mounted on the housing so as to slide in a locking direction between a pre-locking position and a locking position. The housing comprises a housing body and a latch provided with a protuberance, or a tooth, with a locking surface. Moreover, the latch extends between a junction that joins it to the body of the housing and the locking surface in a direction opposite to the locking direction. Advantageously, the protuberance, or the tooth, having the first locking surface is designed to penetrate into the notch.

According to another aspect, a method for connecting and disconnecting an electrical connector with a mating connector may be a method in which the connector comprises a housing and a locking device mounted on the housing so as to slide, in a locking direction, between a pre-locking position and a locking position. According to this method, a pressure is exerted on the locking device, when the latter is in its pre-locking position. This pressure, during this first phase, makes it possible to move the connector and the mating connector with respect to one another as far as a final coupling position in which the connector and the mating connector are fully coupled. During this first phase, the locking device remains in the pre-locking position. When pressure continues to be exerted on the locking device, while the connector and the mating connector are fully coupled, the locking device is moved, during a second phase, into its locking position. In order to uncouple the connector and the mating connector, the locking device is moved from its locking position to its pre-locking position only by exerting traction on the locking device, while the connector and the mating connector are in their final coupling position. In other words, it is not necessary to use a tool to move the locking device from its locking position to its pre-locking position. When the locking device is in the pre-locking position and the traction continues to be exerted on the locking device, while the latter is in the pre-locking position, it is possible to disconnect the connector and the mating connector.

This method therefore makes it possible to realize a coupling or uncoupling function in one step.

BRIEF DESCRIPTION OF THE DRAWINGS

Further features, aims and advantages of the invention will become apparent from reading the following detailed description, and with reference to the appended drawings, which are given by way of non-limiting examples and in which.

In the figures, the same reference numerals denote identical or similar elements.

DETAILED DESCRIPTION

Figure 1:
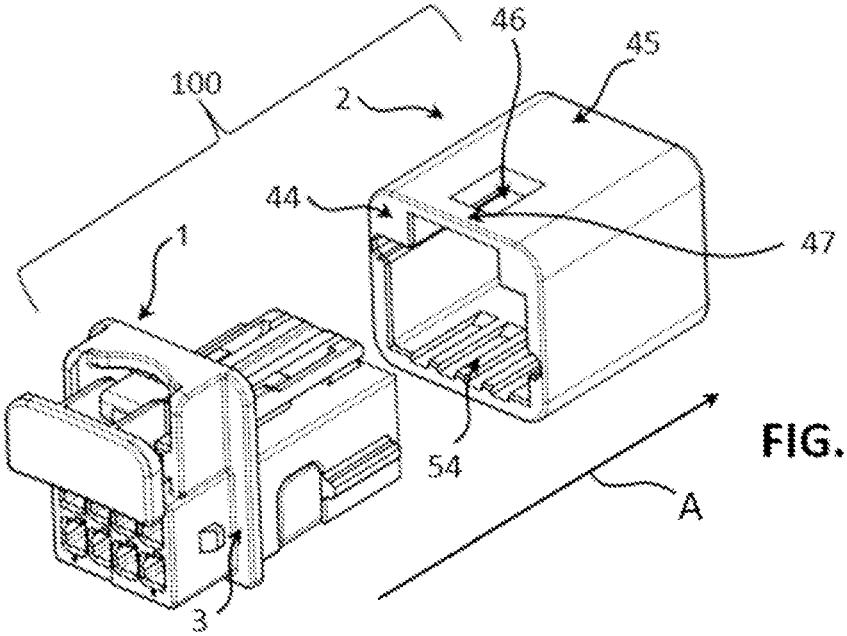
FIG. 1 schematically shows a perspective view of a first embodiment example of a set of electrical connectors.

A first embodiment example of a set 100 of electrical connectors is shown in FIG. 1. This set 100 of electrical connectors comprises a connector 1 and a mating connector 2. In this example, the connector 1 is a female connector and the mating connector 2 is a male connector (but the reverse could be the case). The connector 1 and the mating connector 2 are aligned in a coupling direction A. They are oriented so as to be coupled together, when one is moved relative to the other, parallel to the coupling direction A, as far as a final coupling position.

Figure 2:
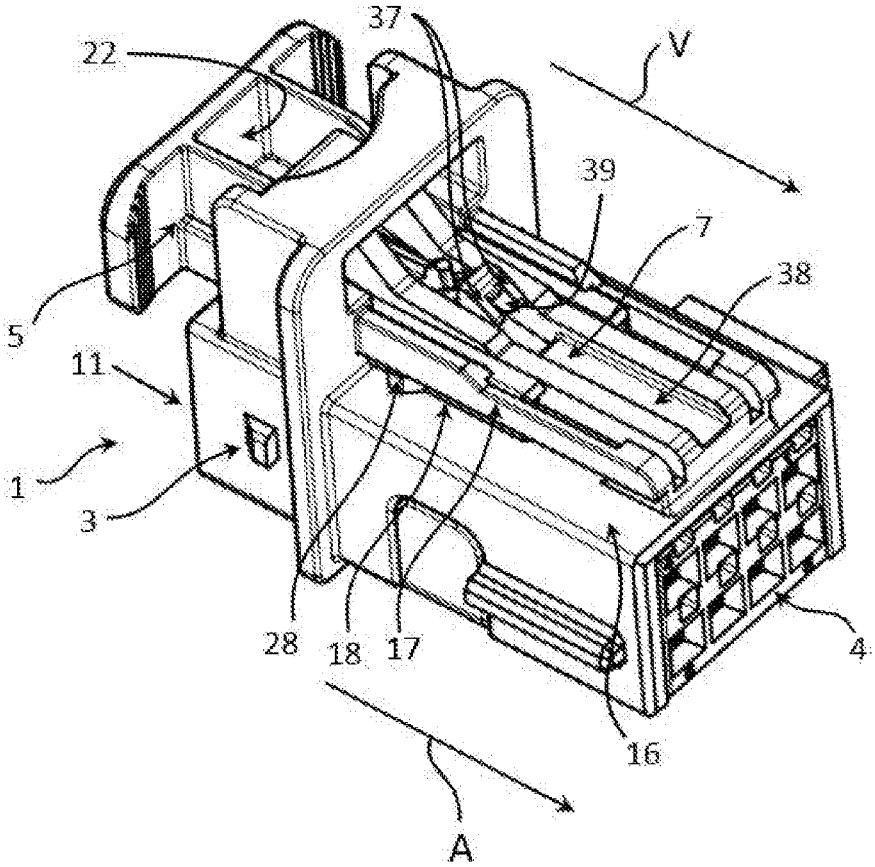
FIG. 2 schematically shows a perspective and partially cutaway view (the roof of the protective cavity being removed) of the connector of the set of connectors shown in FIG. 1.

As shown in FIG. 2, the connector 1 comprises a housing 3, a front grid 4 and a locking device 5.

The housing 3 is made in one piece, for example moulded from plastics material. It comprises a housing body 6 and a latch 7. The housing body 6 has cavities 8 intended to accommodate female electrical contacts 9 (see for example FIGS. 5 to 8). Electrical wires 10 are electrically connected to the contacts 9 and emerge through the rear face 11 of the housing 3. The cavities 8 open onto the front face 12 of the housing 3 at openings 13 through which pins 14 of male contacts of the mating connector 2 are introduced. The housing 3 has a lower face 15 and an upper face 16. The upper face 16 is provided with low walls 17 extending longitudinally parallel to the coupling direction A and upwards, away from the upper face 16. A longitudinal slot 18 is made through each of the low walls 17 (see FIG. 2).

Figure 3:
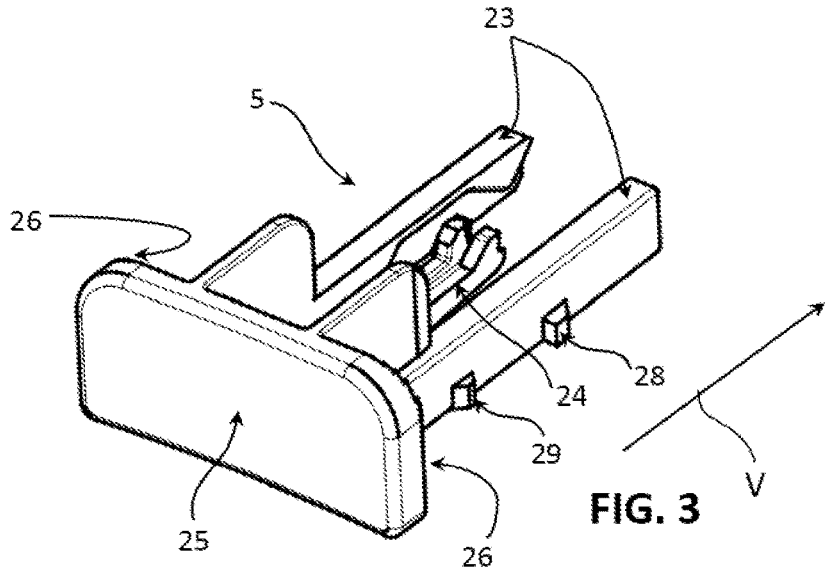
FIG. 3 schematically shows a perspective view of the locking device of the connector shown in FIG. 2.
Figure 4:
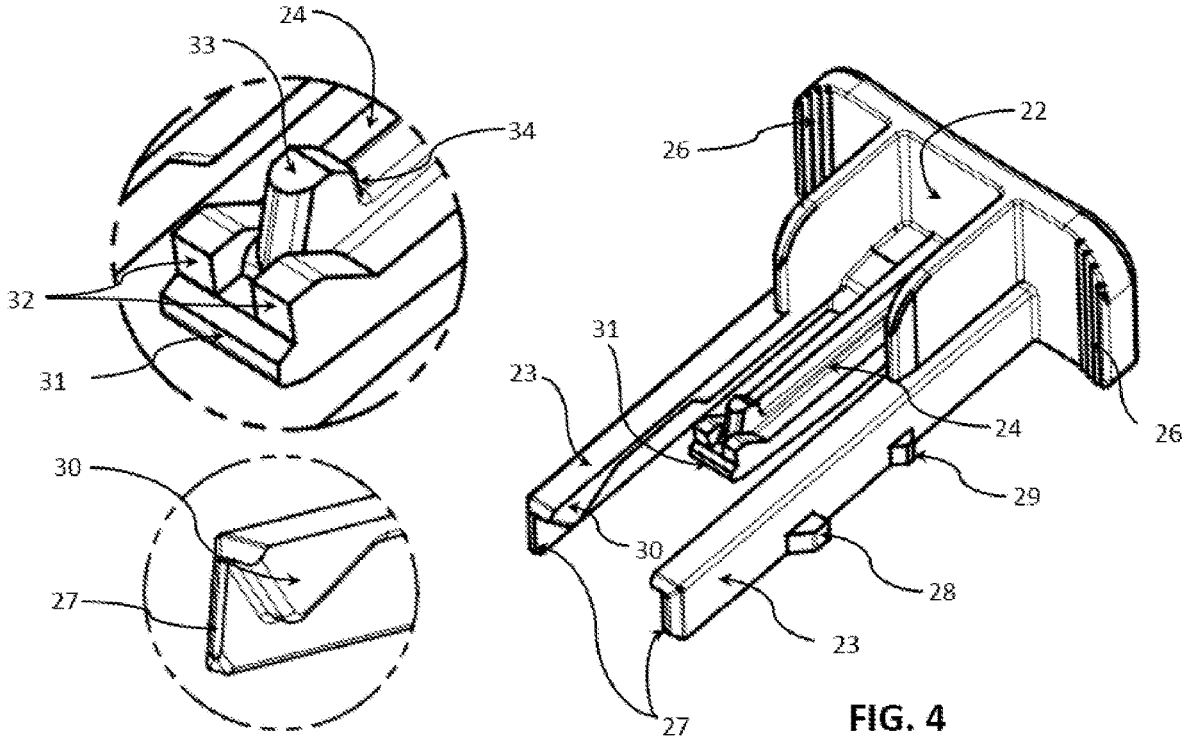
FIG. 4 schematically shows a perspective view of the locking device of the connector shown in FIG. 3, viewed from a different angle and with enlarged parts.
Figure 5:
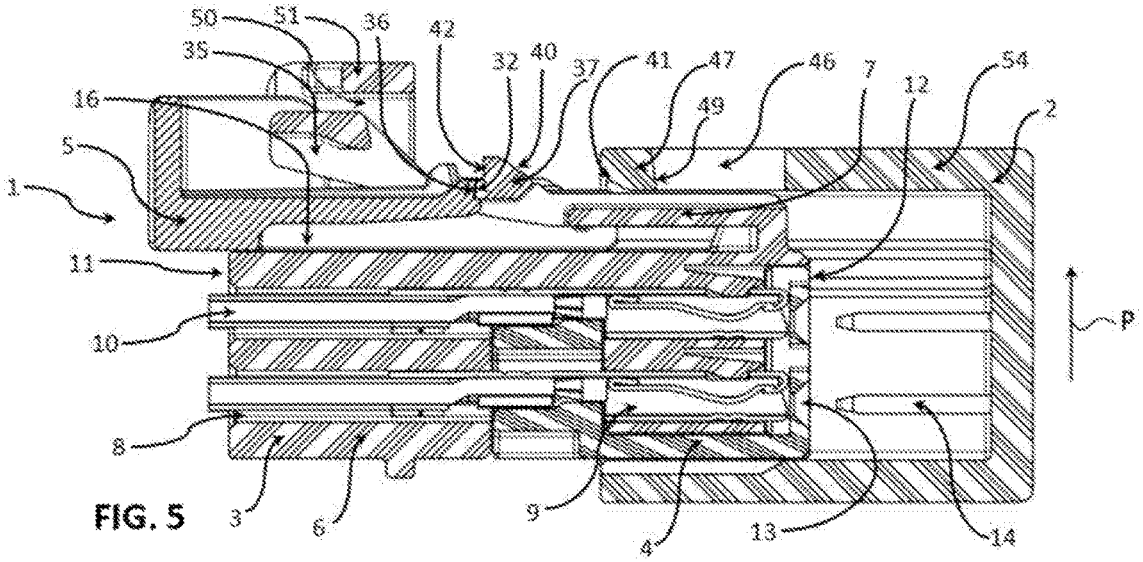
FIG. 5 schematically shows, in longitudinal section, the embodiment of the set of electrical connectors shown in FIG. 1, the connector and the mating connector being partially engaged with one another.
Figure 6:
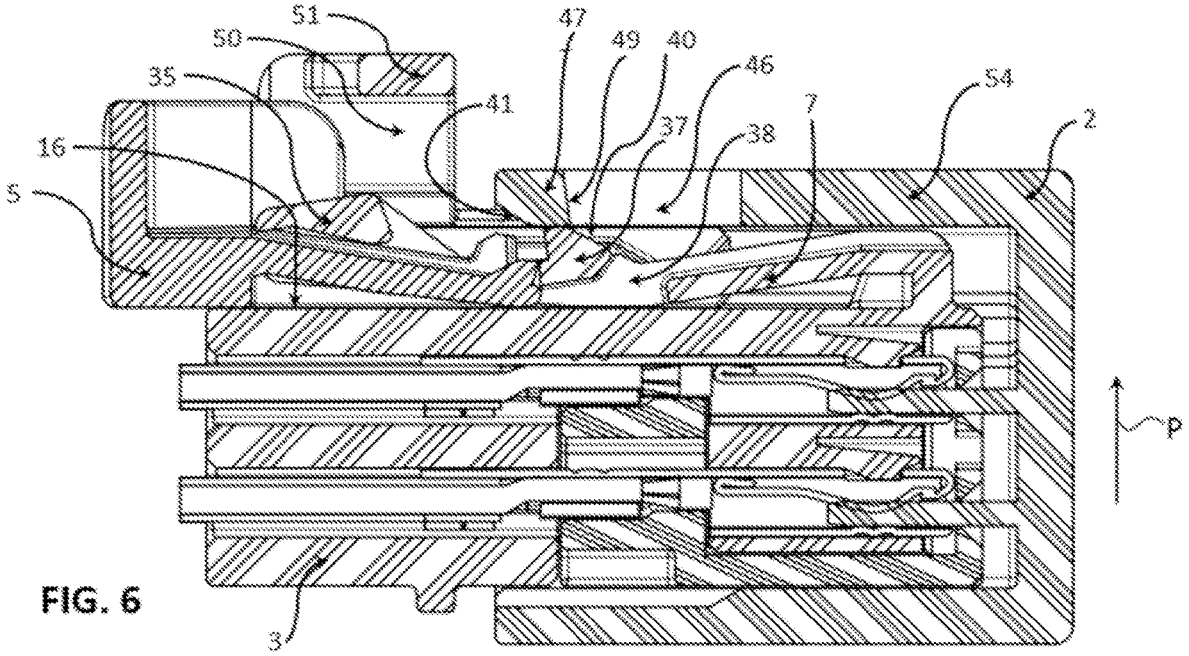
FIG. 6 schematically shows, in longitudinal section, the embodiment of the set of electrical connectors shown in FIGS. 1 and 5, the connector and the mating connector being further engaged with one another compared with their position shown in FIG. 5.
Figure 7:
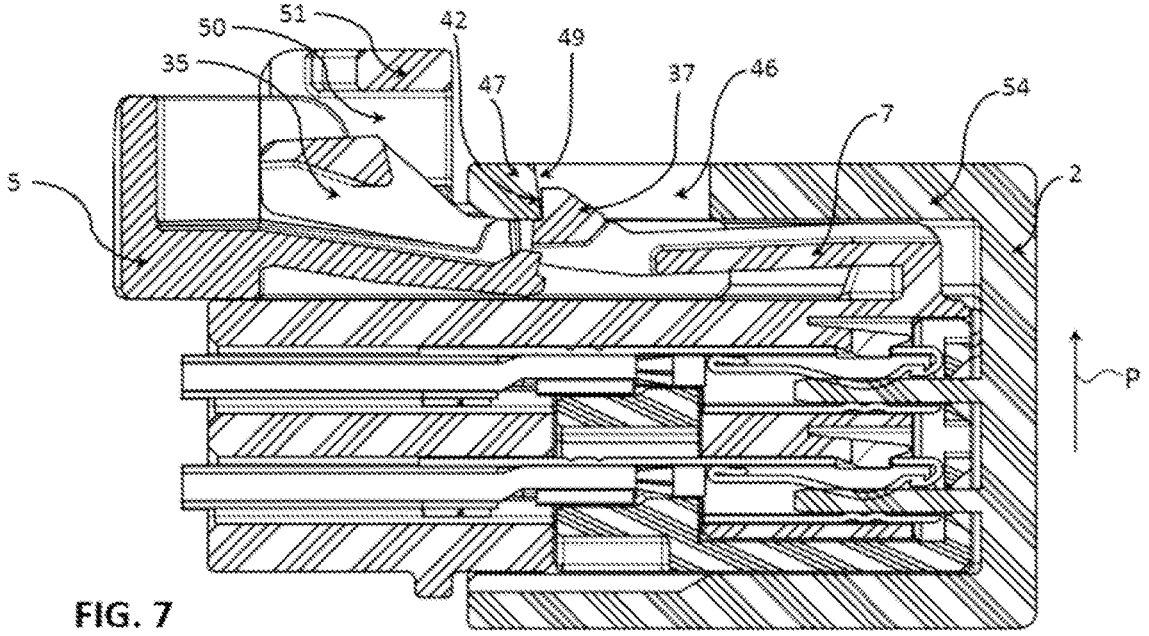
FIG. 7 schematically shows, in longitudinal section, the embodiment of the set of electrical connectors shown in FIGS. 1, 5 and 6, the connector and the mating connector being in a fully coupled position, while the locking device is still in the pre-locking position.
Figure 8:
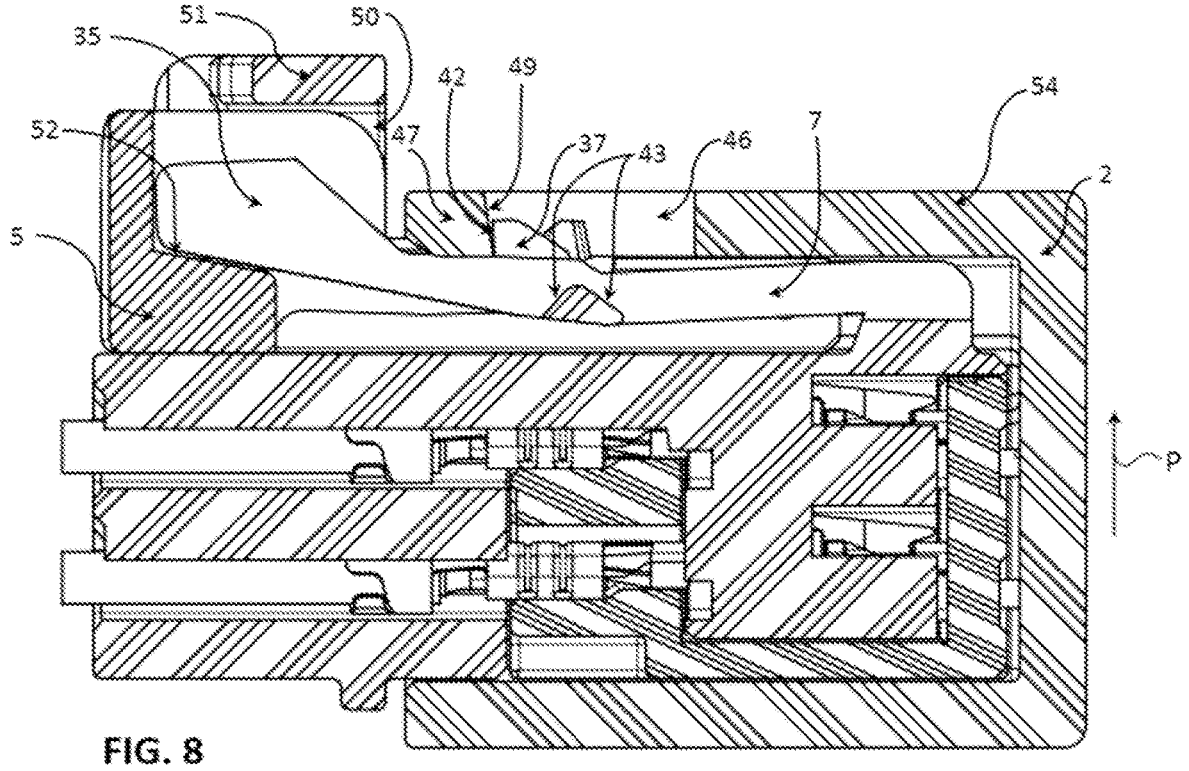
FIG. 8 schematically shows, in longitudinal section, the embodiment of the set of electrical connectors shown in FIGS. 1 and 5 to 7, the connector and the mating connector being in a fully coupled position, while the locking device is in the locking position.
Figure 9:
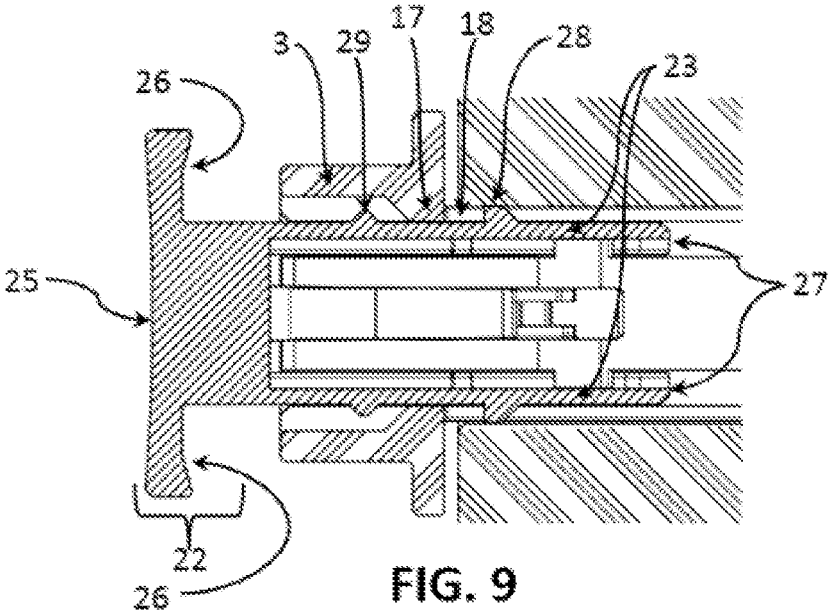
FIG. 9 schematically shows, in longitudinal section, in a plane perpendicular to the one in FIGS. 5 to 8, the connector of the set of electrical connectors shown in FIG. 1.

The locking device 5 acts as a device for ensuring the position of the connectors (or "CPA", for connector position assurance). Thus, it prevents incorrect coupling of the connector 1 to the mating connector 2. The locking device 5 is mounted on the housing 3 so as to slide in a locking direction V between a pre-locking position and a locking position. In the present case, the locking direction V corresponds to the coupling direction A. In FIGS. 1 and 2, the locking device 5 is in the pre-locking position. As shown in FIGS. 3 and 4, the locking device 5 is formed in one piece, for example moulded from plastics material. The locking device 5 has an actuating portion 22, two retaining legs 23 and a locking arm 24. The actuating portion 22 has a thrust surface 25 and two traction wings 26. The thrust surface 25 extends substantially in a plane perpendicular to the locking direction V and is directed towards the rear of the connector 1 when the locking device 5 is mounted on the housing 3. The thrust surface 25 is intended to take the pressure of an operator's finger in order to move the locking device 5 from its pre-locking position to its locking position. The traction wings 26 make it possible to grip the locking device 5 between two fingers (thumb and index finger, for example) in order to pull the locking device 5 from its locking position towards its pre-locking position. The two retaining legs 23 extend substantially in a plane (plane of the sheet relative to FIG. 9) parallel to the locking direction V between an end joined to the actuating portion 22 and a free end 27. The two retaining legs 23 are flexible and their free ends 27 can be moved elastically towards one another. The retaining legs 23 each have, on an external face, a retaining lug 28 and a locking lug 29 and, on an internal face, close to the free end 27, a deflection ramp 30. Each retaining leg 23 has, from the actuating portion 22 towards its free end 27, a locking lug 29, then a retaining lug 28, then a deflection ramp 30. As explained below, the retaining lugs 28 make it possible to retain the locking device 5 on the housing 3, in the pre-locking position. The locking lugs 29 make it possible to retain the locking device 5 on the housing 3, in the locking position. Each deflection ramp 30 is intended to interact with the latch 7 of the housing 3.

The locking arm 24 extends substantially parallel to the locking direction V between an end joined to the actuating portion 22 and a free end 31. The locking arm 24 is flexible and is articulated at the point where it is joined to the actuating portion 22. Its free end 31 can be elastically moved in a direction P substantially perpendicular to the plane in which the retaining legs 23 extend (see for example FIGS. 5 to 7). At its free end 31, the locking arm 24 has two stop surfaces 32 and a finger 33 (see FIG. 4).

The stop surfaces 32 are substantially perpendicular to the locking direction V and directed in the opposite direction to the thrust surface 25. As explained below, the stop surfaces 32 are intended to interfere with the latch 7 of the housing 3 in order to prevent the locking device 5 from moving from its pre-locking position to its locking position. The finger 33 makes it possible to release the stop surfaces 32 so as to allow the locking device to move to its locking position. The finger 33 has a retraction ramp 34 that is directed upwards and towards the actuating portion 22.

Figure 12:
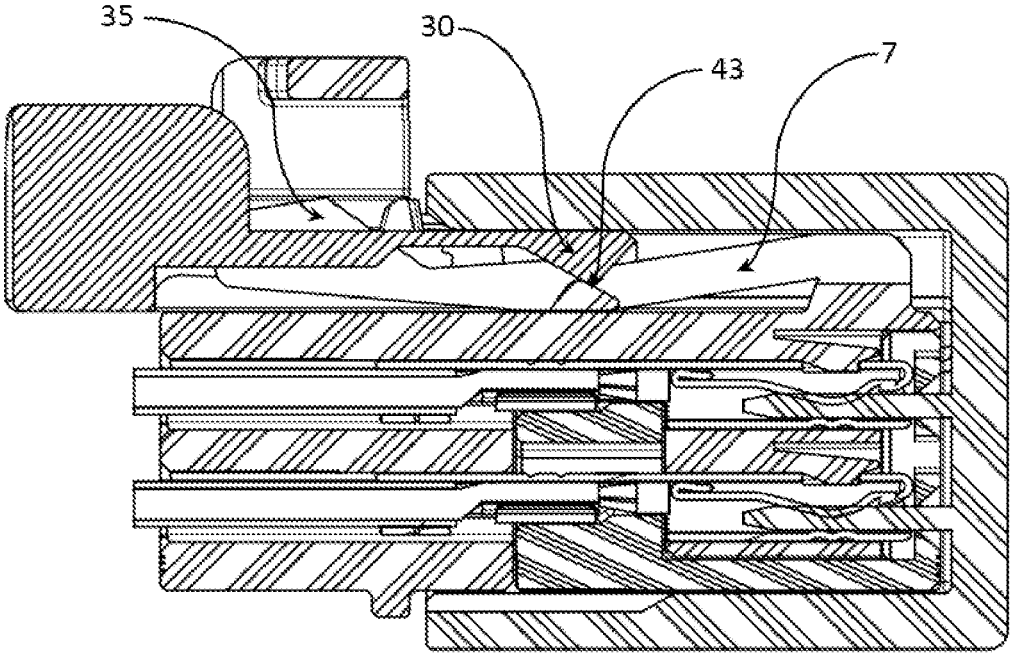
FIG. 12 schematically shows, in longitudinal section, in a plane parallel to the one in FIGS. 5 to 7, the first embodiment of the set of electrical connectors, the connector and the mating connector being in the fully coupled position while the locking device has been pulled towards its pre-locking position.

The latch 7 is integral with the housing 3. It is formed by an arm 38 extending substantially parallel to the locking direction V between an end securely fixed to the housing 3 and a free end 35. The fixed end, which forms a junction with the body 6 of the housing, is situated further towards the front of the housing 3 than the free end 35. The latch 7 is flexible and articulated to the housing 3 at its fixed end. The free end 35 can be moved elastically in the direction P. The latch 7 has two blocking surfaces 36 and two locking surfaces 42 that are substantially perpendicular to the locking direction V and directed in the opposite direction to the stop surfaces 32. Thus, the latch 7 is a latch referred to as a "rear latch" since the blocking surfaces 36 and locking surfaces 42 are situated towards the rear of the connector 1, while it is articulated towards the front of the connector 1. The latch 7 thus extends between a junction that joins it to the body 6 of the housing at least as far as the blocking surfaces 36 and locking surfaces 42, in a direction opposite to the locking direction V. The blocking surfaces 36 are designed to cooperate with the stop surfaces 32 of the locking device 5 so as to prevent the latter from moving from its pre-locking position to its locking position, if the connector 1 and the mating connector 2 are not correctly coupled (see FIG. 5). The blocking surfaces 36 are each carried by a respective tooth 37 forming a detent. The two teeth 37 extend upwards from the arm 38 of the latch 7, in other words away from the upper face 16 of the housing 3, protruding from the top of the latter (see for example FIG. 2). The two teeth 37 are spaced apart from one another in a direction perpendicular to the locking direction V. The space 39 between the two teeth 37 allows the finger 33 of the locking device 5 to pass through. Each of the teeth 37 has a ramp 40 angled upwardly and towards the front of the connector 1. Each ramp 40 is designed to cooperate with an activation surface 41 situated on the mating connector 2 in order to deflect the arm 38 of the latch 7 towards the upper face 16 of the housing 3 (see for example FIG. 6). Each of the teeth 37 also has a locking surface 42 situated above each blocking surface 36. These locking surfaces 42 are designed to cooperate with the mating connector 2 in order to keep the connector 1 and the mating connector 2 in the final coupling position. The latch 7 also has inclined flanks 43 intended to cooperate with the deflection ramps 30 (see for example FIGS. 8 and 12).

The mating connector 2 also has a housing made in one piece, for example moulded from plastics material. The mating connector 2 has cavities (not shown) in which male contacts are mounted. As shown in FIG. 1, the mating connector 2 has a coupling face 44 with an opening into which the connector 1 is introduced. The mating connector also has a skirt 54 with an upper face 45. More particularly, the mating connector 2 has a skirt 54, inside which the latch 7 is primarily accommodated when the connector 1 and the mating connector 2 are in the final coupling position. An aperture 46 is provided in the upper face 45. The aperture 46 is designed to receive the teeth 37 of the latch 7 when the connector 1 and the mating connector 2 are in the final coupling position. The housing of the mating connector 2 thus has, on its upper face 45, a bar 47 separating the aperture 46 from the opening in the coupling face 44. This bar 47 has an activation surface 41 by the opening, said surface being designed to cooperate with the ramps 40 of the latch 7 in order to deflect the arm 38 of the latch 7 towards the housing 3 of the connector 1. This bar 47 also has a blocking face 49 designed to cooperate with the locking surfaces 42 of the latch 7.

The sequence of coupling and uncoupling the connector 1 and the mating connector 2 is described below.

The locking device 5 is mounted on the housing 3 of the connector 1 in that the retaining legs 23 are inserted into grooves formed in the top of the connector 1. This insertion is realized by moving the locking device 5 from the rear of the housing 3 and by optionally pushing on the thrust surface 25 in order to move it from the rear to the front of the housing 3, in the locking direction V. During this insertion, the retaining legs 23 are deflected towards one another until the retaining lugs 28 pass into the slots 18 made in the low walls 17 situated on the upper face 16 of the housing 3 (see FIG. 2). When the retaining lugs 28 are placed in the slots 18, the retaining legs 23 return elastically into a position in which they are not stressed. Furthermore, the movement of the locking device 5 towards the front is stopped when the stop surfaces 32 interfere with the blocking surfaces 36 of the latch 7 (see FIG. 5). The latch 7 is then in a blocking position and the locking device 5 is secured to the housing and in the pre-locking position.

Figure 10:
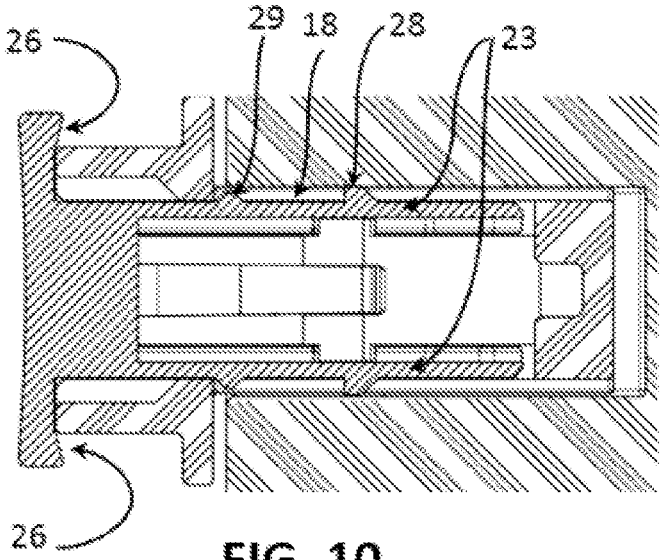
FIG. 10 schematically shows, in longitudinal section, in the plane of FIG. 9, a detail of the interaction of the locking device with the connector housing of the set of electrical connectors shown in FIG. 1, on which it is mounted.

The connector 1 provided with the locking device 5 is disposed facing the mating connector 2, then the front end of the connector 1 is introduced into the opening in the coupling face 44 of the mating connector 2. Since the locking device 5 is blocked in the pre-locking position on the housing 3 by the cooperation of the stop surfaces 32 with the blocking surfaces 36, the pressure exerted by the operator on the thrust surface 25 makes it possible to further engage the connector 1 in the mating connector 2. The connector 1 is thus engaged in the mating connector 2 until the ramps 40 interfere with the activation surface 41 (see FIG. 6). By continuing to exert a pressure on the thrust surface 25, the operator forces the latch 7 to retract under the bar 47 under the effect of the ramps 40 sliding over the activation surface 41 of the bar 47. This causes the teeth 37 to move towards the upper face 16 of the housing 3. The teeth 37 themselves then cooperate, by engagement of two complementary corner shapes (at the base of the stop surface 32 and blocking surface 36), with the locking arm 24, forcing the latter downwards likewise towards the upper surface 16 of the housing 3. The finger 33 is thus also lowered and passes under the bar 47, under and by which it remains held such that the locking arm 24 remains deformed, lowered towards the upper surface 16 of the housing 3. In other words, the latch 7 has flexed from a blocking position to a retracted position (see FIG. 7). By contrast, as soon as the teeth 37 of the latch 7 arrive at the aperture 46, they pass into the latter, the latch 7 returns elastically into the less stressed position (little or no stress) and the locking surfaces 42 fit behind the blocking face 49 of the bar 47 in order to lock the connector 1 and the mating connector 2 in the fully coupled state, that is to say in the final coupling position. In this way, a function of primary locking of the connector 1 and mating connector 2 is obtained. In this position, the latch 7 is raised into a position further away from the upper face 16 of the housing 3 of the connector 1. It thus releases the locking arm 24 and the operator, by way of a single movement, exerting a pressure on the thrust surface 25, and by way of an inertial or go/no-go effect, moves the locking device 5 towards, and then into, its locking position. During this movement, the retaining legs 23 are again elastically deformed by the locking lugs 29 (see FIG. 9), which have ramps designed to cooperate with the low walls 17. When the locking lugs 29 reach the slots 18, the retaining legs 23 return elastically into their unstressed position and the locking device 5 is blocked in this locking position, along the locking direction V. As shown in FIG. 10, it is blocked in the slots 18, towards the front by the retaining lugs 28 and towards the rear by the locking lugs 29.

Furthermore, during this movement, the free end 35 of the latch 7 is placed in a protective cavity 50 made in the locking device 5. In this protective cavity 50, the free end 35 of the latch 7 is protected by a roof 51 (see FIG. 8) such that the free end 35 of the latch 7 is more difficult to access and cannot be accidentally lowered (which could unlock the connector 1 and the mating connector 2 by deactivation of the primary locking). In addition, in this protective cavity 50, the free end 35 of the latch 7 is kept lifted by a support surface 52 so as to support the latch 7 in its locked position. In this locked position, the latch 7 is deflected little if at all. By virtue of the support surface 52, the locking device 5 keeps the locking surfaces 42 behind the blocking face 49 of the bar 47, in order to lock the fully coupled connector 1 and mating connector 2, and ensures secondary locking of the connector 1 and the mating connector 2.

In this embodiment, the locking arm 24 is inserted and protected under the skirt 54 of the mating connector 2, when the connector 1 and the mating connector 2 are in the final coupling position.

Figure 11:
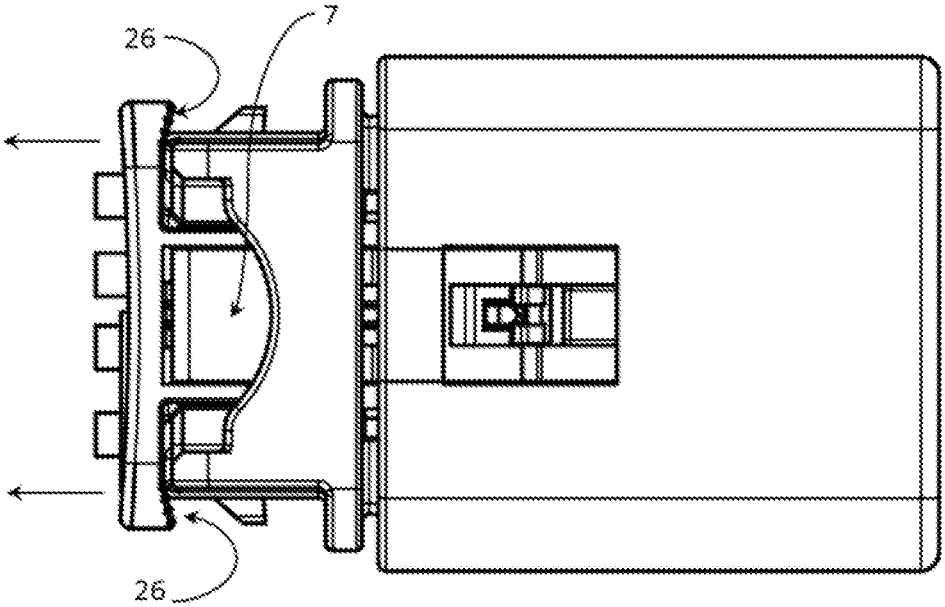
FIG. 11 schematically shows a top view of the set of electrical connectors from FIG. 1, the connector and mating connector being in the fully coupled position.
Figure 13:
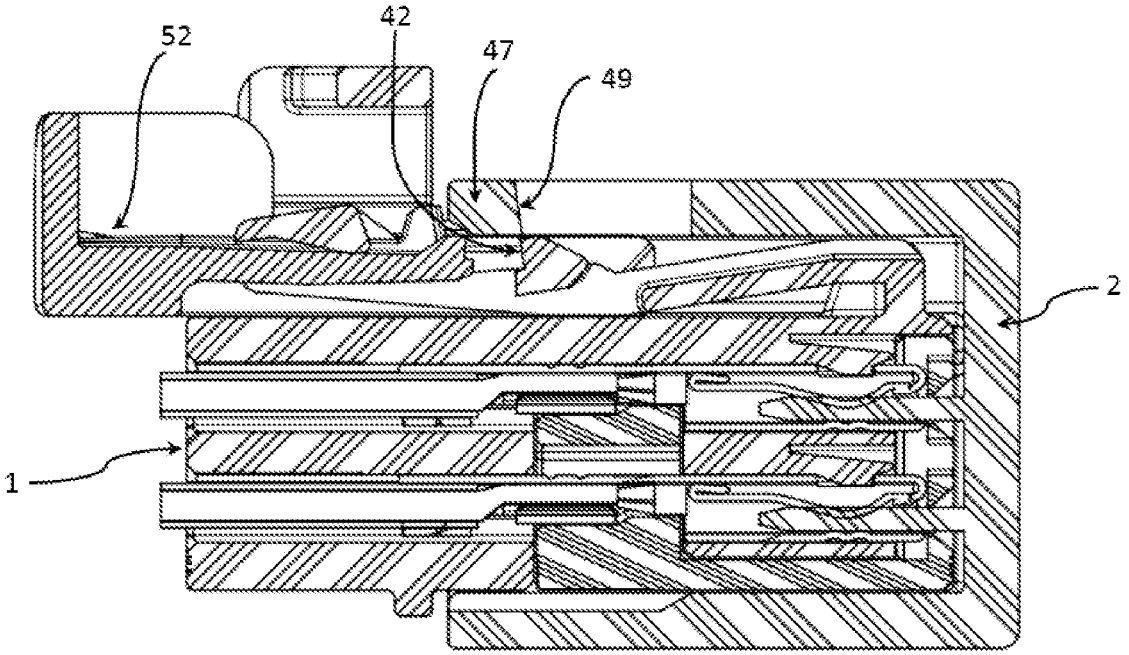
FIG. 13 schematically shows, in longitudinal section, in the plane of FIGS. 5 to 7, the first embodiment of the set of electrical connectors, the connector, the mating connector and the locking device being in the same position as in FIG. 12.
Figure 14:
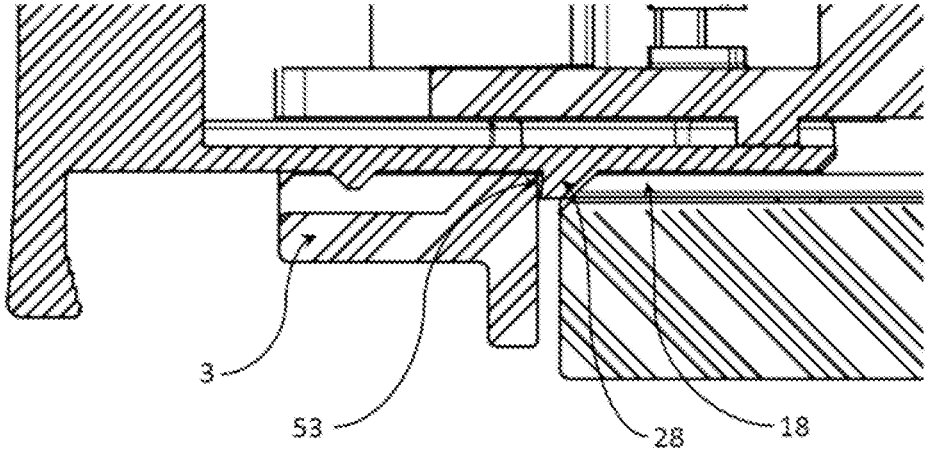
FIG. 14 schematically shows, in longitudinal section, in the plane of FIG. 9 or FIG. 10, a detail of the interaction of the locking device with the connector housing of the set of electrical connectors shown in FIG. 1, on which it is mounted.
Figure 15:
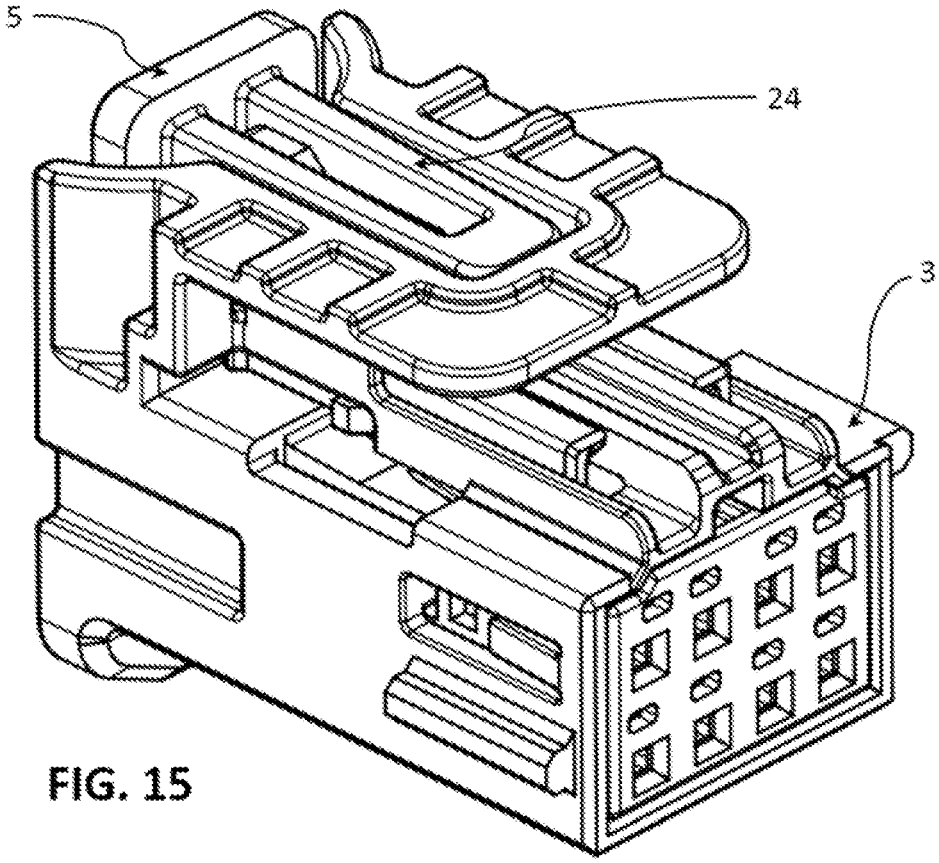
FIG. 15 schematically shows a perspective view of the connector of the second embodiment of the set of connectors.
Figure 16:
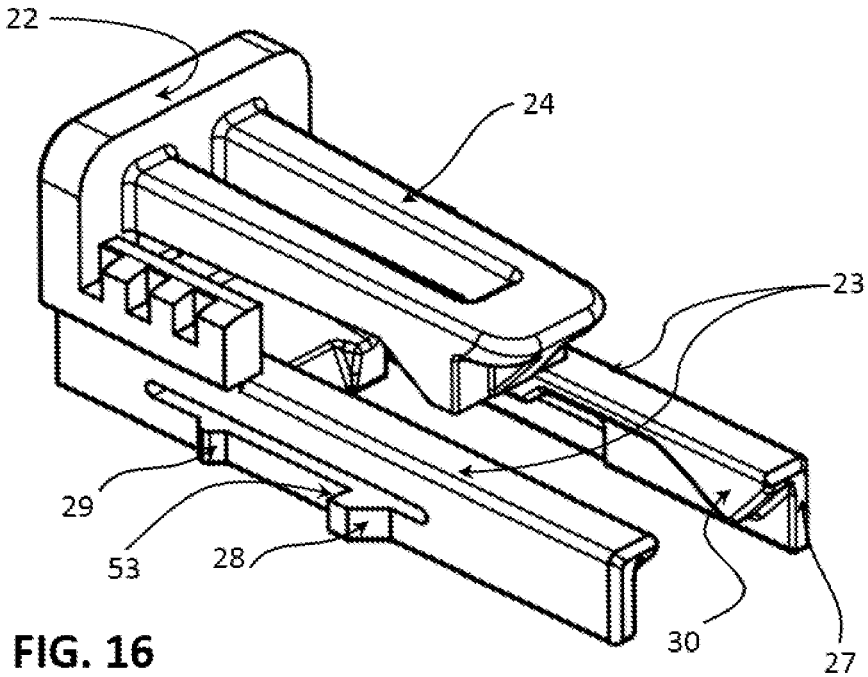
FIG. 16 shows a perspective view of the locking device of the connector shown in FIG. 15.
Figure 17:
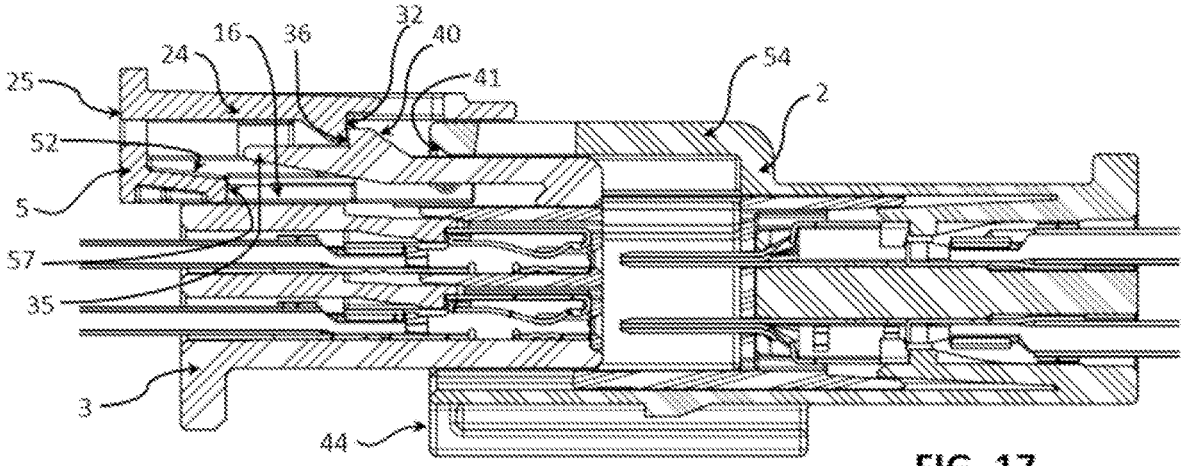
FIG. 17 schematically shows, in longitudinal section, the set of connectors according to the second embodiment, the connector and mating connector being just positioned and introduced one into the other, with the locking device in the pre-locking position.
Figure 18:
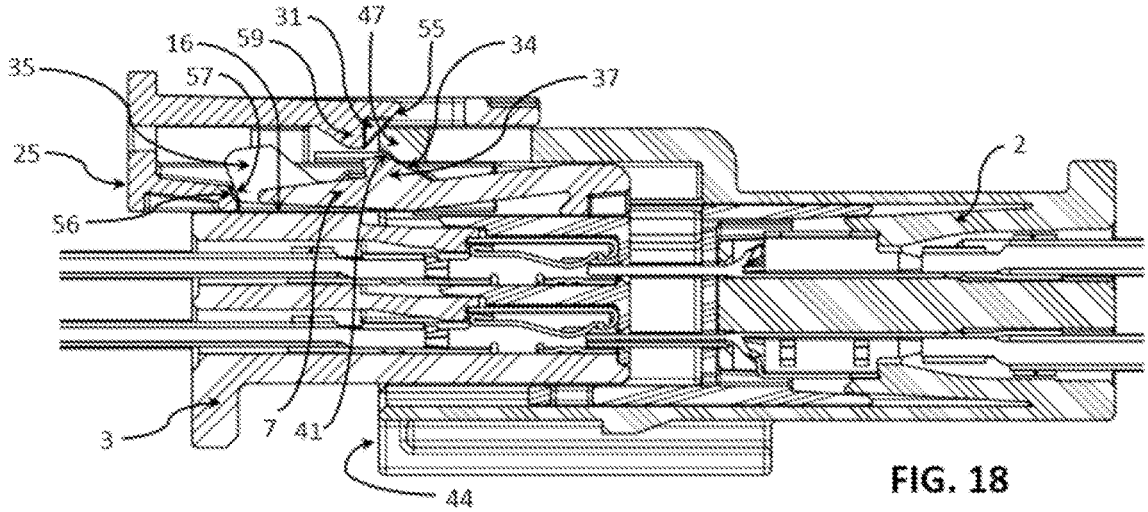
FIG. 18 is a depiction similar to FIG. 17, with the connector and mating connector in an intermediate position between the position corresponding to FIG. 17 and the position in FIG. 19, in which they are fully coupled.
Figure 19:
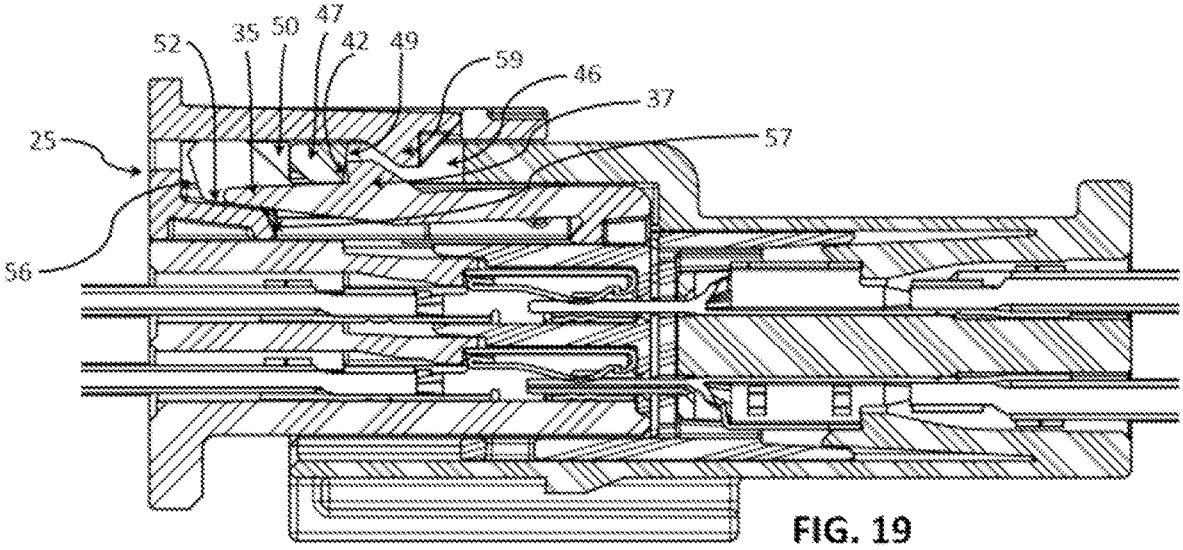
FIG. 19 is a depiction similar to the one in FIGS. 17 and 18, with the connector and mating connector in the fully coupled position and the locking device in the locking position.
Figure 20:
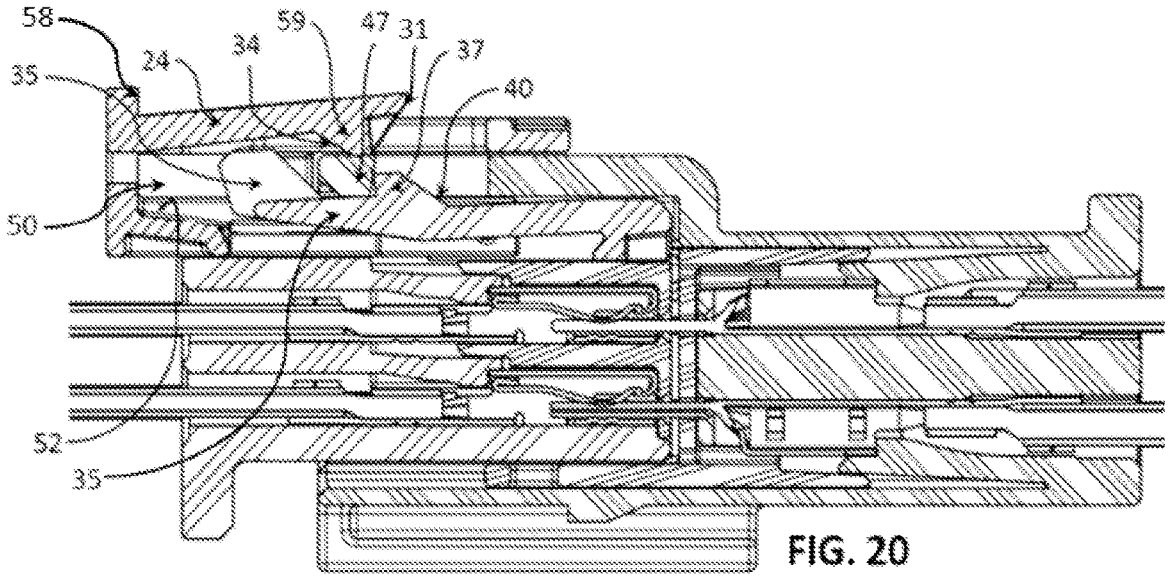
FIG. 20 is a depiction similar to the one in FIGS. 17 to 19, with the connector and mating connector in the fully coupled position and the locking device in the pre-locking position.
Figure 21:
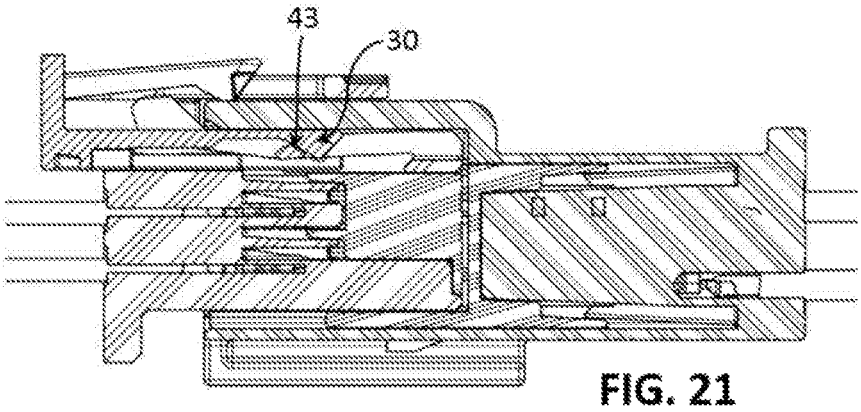
FIG. 21 is a longitudinal section similar to the one in FIGS. 17 to 19, but in a different plane, with the connector and mating connector in the fully coupled position and the locking device in the pre-locking position.
Figure 22:
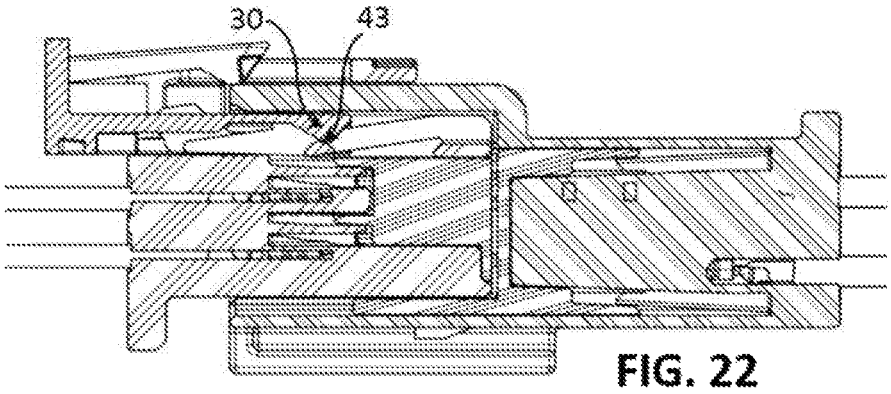
FIG. 22 is a longitudinal section similar to the one in FIG. 21, with the connector and mating connector in the fully coupled position and the locking device in a position in which it has been pulled further than in the pre-locking position.
Figure 23:
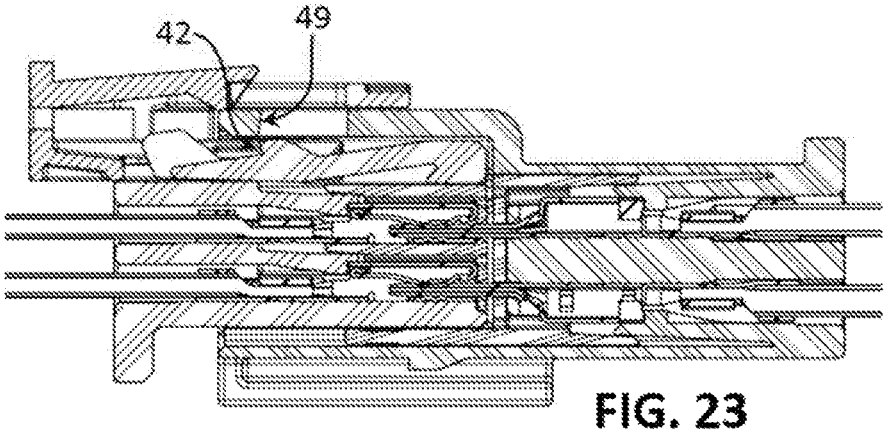
FIG. 23 is a longitudinal section similar to the one in FIG. 20, with the connector and mating connector in the fully coupled position and the locking device in a position in which it has been pulled further than in the pre-locking position.

In order to disconnect the connector 1 and the mating connector 2, the operator pulls on the traction wings 26 of the locking device 5 (see arrows in FIG. 11). The locking device 5 is then moved from its locking position towards its pre-locking position. During this movement of the locking device 5, the locking lugs 29, by virtue of their ramps, force the retaining legs 23 to flex towards one another (see FIG. 10). The free end 35 of the latch 7 is disengaged from the protective cavity 50. Notably, the front end of the latch 7 no longer rests on the support surface 52. By virtue of the cooperation of the bar 47 and the retraction ramp 34 situated on the finger 33 of the locking arm 24, the locking arm 24 is lowered under the bar 47, towards the upper face 16 of the housing 3. However, the locking surfaces 42 remain engaged behind the blocking face 49 of the bar 47. This therefore makes it possible to pull on the locking device 5 to move it towards its pre-locking position without entraining the connector 1, until the deflection ramps 30 interact with the latch 7 (see FIG. 12). The passage of each of the deflection ramps 30 over an inclined flank 43, or unlocking surface, forces the latch 7 to flex towards the upper face 16 of the housing 3. In this way, the locking surfaces 42 are disengaged and released from the blocking face 49 of the bar 47 (see FIG. 13). The connector 1 is then unlocked from the mating connector 2 and continued pulling on the traction wings 26 makes it possible to fully uncouple the connector 1 and the mating connector 2. Specifically, the retaining lugs 28 each have a retaining surface 53 that cooperates with the housing 3 at one end of the slots 18 so as to prevent the locking device 5 from being released from the housing 3 (see FIG. 14).

Another embodiment of a set of connectors is shown in FIGS. 15 to 23. This embodiment differs primarily from the first embodiment in that the locking arm 24 is not inserted under the skirt 54 of the mating connector 2 when the connector 1 and the mating connector 2 are in the final coupling position. The structure of the connector 1 and of the mating connector 2 of this second embodiment has numerous similarities with that of the first embodiment. Therefore, these similarities will, for the most part, not be described again, since it is possible to refer to the first embodiment for a detailed description thereof.

The sequence of coupling and uncoupling the connector 1 and the mating connector 2 of the set of connectors according to this second embodiment is described below.

The locking device 5 is mounted on the housing 3 of the connector 1 in an identical way to the description given in relation to the first embodiment. Therefore, the description of this mounting will not be repeated.

The connector 1 provided with the locking device 5 is disposed facing the mating connector 2, then the front end of the connector 1 is introduced into the opening in the coupling face 44 of the mating connector 2. Since the locking device 5 is blocked in the pre-locking position on the housing 3 by the cooperation of the stop surfaces 32 with the blocking surfaces 36, the pressure exerted by the operator on the thrust surface 25 makes it possible to further engage the connector 1 in the mating connector 2. The connector 1 is thus engaged in the mating connector 2 until the ramps 34 interfere with the activation surface 41 (see FIG. 18). By continuing to exert a pressure on the thrust surface 25, the operator forces the latch 7 to retract under the bar 47 under the effect of the ramps 34 sliding over the activation surface 41 of the bar 47. This causes the teeth 37 to move towards the upper face 16 of the housing 3. In other words, the latch 7 has flexed from a blocking position to a retracted position. This flexing of the latch 7 causes a stop surface 56 situated at the free end 35 of the latch 7 to cooperate with a complementary stop surface 57 situated on the locking device 5. In this way, the locking device 5 remains blocked in the pre-locking position and continues to entrain the housing 3 when the operator presses the thrust surface 25. The operator thus continues to engage the connector 1 in the mating connector 2 by pressing on the thrust surface 25, and causes the free end 31 of the locking arm 24 to interact with the bar 47. A ramp 55 is disposed on a lug 59 positioned in the vicinity of the free end 31 of the locking arm 24. This ramp 55 has a surface oriented towards the front and towards the upper face 16 of the housing 3 which makes it possible to lift the free end 31 of the locking arm 24 over the bar 47, away from the upper face 16. As soon as the teeth 37 of the latch 7 arrive at the aperture 46, they pass into the latter, the latch 7 returns elastically into the less stressed position (little or no stress) and the locking surfaces 42 fit behind the blocking face 49 of the bar 47 in order to lock the connector 1 and the mating connector 2 in the fully coupled state, that is to say in the final coupling position (see FIG. 19). In this way, a function of primary locking of the connector 1 and mating connector 2 is obtained. In this position, the latch 7 is raised into a position further away from the upper face 16 of the housing 3 of the connector 1. The stop surface 56 situated at the free end 35 of the latch 7 is released from the complementary stop surface 57 situated on the locking device 5. The forward movement of the locking device 5, from its pre-locking position to its locking position, is then released and the operator, by way of a single movement, exerting a pressure on the thrust surface 25, and by way of an inertial or go/no-go effect, moves the locking device 5 towards, and then into, its locking position. During this movement, the retaining legs 23 are again elastically deformed by the locking lugs 29, which have ramps designed to cooperate with the low walls 17. When the locking lugs 29 reach the slots 18, the retaining legs 23 return elastically into their unstressed position and the locking device 5 is blocked in this locking position, along the locking direction V. Moreover, the lug 59 is placed in the aperture 46, behind the teeth 37 of the latch 7, thereby also helping to block the locking device 5 in this locking position.

Furthermore, during this movement, the free end 35 of the latch 7 is placed in a protective cavity 50 made in the locking device 5. In this protective cavity 50, the free end 35 of the latch 7 is protected by a roof 51 such that the free end 35 of the latch 7 is more difficult to access and cannot be accidentally lowered (which could unlock the connector 1 and the mating connector 2 by deactivation of the primary locking). In addition, in this protective cavity 50, the free end 35 of the latch 7 is kept lifted by a support surface 52 so as to support the latch 7 in its locked position. In this locked position, the latch 7 is deflected little if at all. By virtue of this support surface 52, the locking device 5 keeps the locking surfaces 42 behind the blocking face 49 of the bar 47, in order to lock the fully coupled connector 1 and mating connector 2, and ensures secondary locking of the connector 1 and the mating connector 2.

In order to disconnect the connector 1 and the mating connector 2, the operator pulls on a lip 58 situated on the actuating portion 22 of the locking device 5. The locking device 5 is then moved from its locking position towards its pre-locking position. During this movement of the locking device 5, the locking lugs 29, by virtue of their ramps, force the retaining legs 23 to flex towards one another. In parallel, the free end 31 of the locking arm 24 is guided upwards by inclined guide surfaces 60 situated on the latch 7. The free end 31 of the locking arm 24 thus passes over the teeth 37, and then over the bar 47 (see FIG. 20). The free end 35 of the latch 7 is disengaged from the protective cavity 50. Notably, the front end of the latch 7 no longer rests on the support surface 52. By virtue of the cooperation of the bar 47 and the retraction ramp 34 situated on the lug 59 of the locking arm 24, the locking arm 24 is lifted over the bar 47, away from the upper face 16 of the housing 3. However, the locking surfaces 42 remain engaged behind the blocking face 49 of the bar 47. This therefore makes it possible to pull on the locking device 5 to move it beyond its pre-locking position without entraining the connector 1, until the deflection ramps 30 interact with the latch 7 (see FIG. 21). The passage of each of the deflection ramps 30 over an inclined flank 43, or unlocking surface, forces the latch 7 to flex towards the upper face 16 of the housing 3 (see FIG. 22). In this way, the locking surfaces 42 are disengaged and released from the blocking face 49 of the bar 47 (see FIG. 23). The connector 1 is then unlocked from the mating connector 2 and continued pulling on the traction wings 26 makes it possible to fully uncouple the connector 1 and the mating connector 2. Specifically, the retaining lugs 28 each have a retaining surface 53 that cooperates with the housing 3 at one end of the slots 18 so as to prevent the locking device 5 from being released from the housing 3. When the operator lets go of the locking device 5, the elasticity of the latch 7 makes it possible, through the cooperation of each of the deflection ramps 30 on an inclined flank 43, for the locking device 5 to return rearwards slightly, into the pre-locking position (see FIG. 17).

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

The invention claimed is:

1. A set of electrical connectors comprising:

a connector and a mating connector, the mating connector includes a bar with a blocking face, the connector and the mating connector being configured to be coupled together when one is moved relative to the other in a coupling direction as far as a final coupling position, the connector comprising a housing and a locking device mounted on the housing so as to slide in a locking direction between a pre-locking position and a locking position, the housing comprising a housing body and a latch provided with a locking surface configured to cooperate with the blocking face for locking the connector to the mating connector, wherein the latch extends in a direction opposite to the coupling direction between a junction that joins the latch to the housing body and at least the locking surface, and the latch has an unlocking surface that cooperates with the locking device in order to release the latch from the mating connector by disengaging the locking surface from the blocking face when the locking device is moved from the locking position to the pre-locking position.

2. The set of connectors according to claim 1, wherein the latch includes a blocking surface, the latch flexes from a blocking position to a retracted position, in the blocking position the blocking surface cooperates with the locking device to block movement of the locking device towards the locking position when the locking device is in the pre-locking position, in the retracted position the mating connector cooperates with the latch to release the locking device from the blocking surface, and the blocking surface is situated along the latch on a same side as the locking surface with respect to the junction that joins the latch to the housing body.

3. The set of connectors according to claim 1, wherein the mating connector has a skirt, the latch is primarily accommodated in the skirt when the connector and the mating connector are in the final coupling position.

4. The set of connectors according to claim 3, wherein the locking device has a locking arm that is primarily accommodated inside the skirt when the connector and the mating connector are in the final coupling position.

5. The set of connectors according to claim 1, wherein the latch has a protuberance or a tooth, and the mating connector has a notch or an aperture, the protuberance or the tooth is inserted into the notch or the aperture to allow the latch to return elastically into the blocking position, and in which the blocking position the protuberance or the tooth cooperates with the mating connector to ensure primary locking of the connector and the mating connector in the coupling position.

6. The set of connectors according to claim 5, wherein the locking device comprises a locking arm including a lug or a finger that cooperates with the mating connector to keep the locking arm flexed and to allow the locking device to be moved from the pre-locking position into the locking position; and the lug or the finger is accommodated in the notch or the aperture when the locking device is in the locking position.

7. The set of connectors according to claim 1, wherein the locking device includes a support surface that cooperates with the latch in order to effect secondary locking of the connector and the mating connector in the coupling position.

8. The set of connectors according to claim 1, wherein the locking device includes a wall or a roof at least partially covering a free end of the latch when the locking device is in the locking position.

9. The set of connectors according to claim 1, wherein the latch is released from the mating connector upon engagement of the unlocking surface with the locking device when the locking device is moved from the locking position to the pre-locking position.

10. A connector for connecting to a mating connector, the connector comprising:

a housing including an upper face, a housing body, and a latch including a protuberance or a tooth, the protuberance or tooth including a locking surface; and a locking device mounted on the housing and configured to slide in a locking direction between a pre-locking position and a locking position, wherein the latch extends between a junction that joins the latch to the housing body and the locking surface in a direction opposite to the locking direction, and the latch includes an unlocking surface that is configured to cooperate with the locking device and force the latch to flex toward the upper face of the housing in response to the locking device being moved from the locking position to the pre-locking position.

11. The connector according to claim 10, wherein the locking device comprises retaining lugs, and the retaining lugs each have a retaining surface that cooperates with the housing and prevents the locking device from being released from the housing when in the pre-locking position.

12. A method of connecting and disconnecting the connector and the mating connector of the set of connectors of claim 1, the method comprising:

exerting pressure on the locking device when the locking device is in the pre-locking position to cause relative movement between the connector and the mating connector as far as a final coupling position in which the connector and the mating connector are fully coupled;

after the connector and the mating connector have been placed in the final coupling position, continuing to exert pressure on the locking device to move the locking device into the locking position;

moving the locking device from the locking position to the pre-locking position only by exerting traction on the locking device while the connector and the mating connector are in the final coupling position; and disconnecting the connector and the mating connector by continuing to exert the traction on the locking device while the locking device is in the pre-locking position, without operating another action than continuing to exert the traction.

* * * * *